US005782228A

United States Patent [19]

Wu

[11] Patent Number: 5,782,228

[45] Date of Patent: Jul. 21, 1998

[54] TOY FLYING DISK AND LAUNCHER SYSTEM

[76] Inventor: Wen-Long Wu, No. 5, Alley 26, Lane 62, Tung-Hsing Rd., Ta-Li City, Taichung Hsien, Taiwan

[21] Appl. No.: 917,357

[22] Filed: Aug. 26, 1997

[51] Int. Cl.[6] ..... F41B 4/00

[52] U.S. Cl. ..... 124/6

[58] Field of Search ..... 124/1, 6, 8, 40, 124/78, 82

[56] References Cited

U.S. PATENT DOCUMENTS

| | | | |
|---|---|---|---|
| 3,717,136 | 2/1973 | Gay et al. | 124/21 |
| 4,672,942 | 6/1987 | Steward | 124/1 |
| 5,050,575 | 9/1991 | Killion | 124/8 |
| 5,471,967 | 12/1995 | Matsuzaki et al. | 124/6 |

*Primary Examiner*—John A. Ricci
*Attorney, Agent, or Firm*—Bacon & Thomas

[57] ABSTRACT

A toy flying disk and disk launcher system including a launching pad coupled to a handle, a disk feeder mounted in a vertical disk feed hole at the launching pad and holding a stack of flying disks, a disk launching control mechanism controlled to push the flying disks out of the disk feeder into the launching position one after another, a motor mounted on the launching pad, a ratchet wheel turned by the motor to send the flying disks one after another from the launching position into the air, a power switch for controlling power supply to the motor, and a safety control device mounted on the launching pad and adapted to switch on/off the power switch and to lock/unlock the disk launching control mechanism.

6 Claims, 10 Drawing Sheets

TOY FLYING DISK AND LAUNCHER SYSTEM

BACKGROUND OF THE INVENTION

The present invention relates to a toy flying disk and disk launcher system which is made in the form of a small gun held with one hand and fired to launch flying disks into the air.

A variety of toy guns with/without sound and light producing means have been disclosed, and have appeared on the market. There are also known toy guns that can be triggered to eject ball bullets. Because these ball bullets are molded from rigid plastic, they may cause an injury when hit a person. Furthermore, these toy guns are complicated and expensive, and it is difficult to collect fired ball bullets.

SUMMARY OF THE INVENTION

It is one object of the present invention to provide a toy flying disk and disk launcher system which can be conveniently operated with one hand to launch flying disks into the air. It is another object of the present invention to provide a toy flying disk and disk launcher system which is safe in use. It is still another object of the present invention to provide a toy flying disk and disk launcher system which has a simple structure. It is still another object of the present invention to provide a toy flying disk and disk launcher system which has safety means to lock the system from firing when the system is not well set. To achieve these and other objects of the present invention, there is provided a toy flying disk and disk launcher system comprised of a launching pad coupled to a handle, a disk feeder mounted in a vertical disk feed hole at the launching pad and holding a stack of flying disks, a disk launching control mechanism controlled to push the flying disks out of the disk feeder into the launching position one after another, a motor mounted on the launching pad, a ratchet wheel turned by the motor to send the flying disks one after another from the launching position into the air, a power switch for controlling power supply to the motor, and a safety control device mounted on the launching pad and adapted to switch on/off the power switch and to lock/unlock the disk launching control mechanism.

DETAILED DESCRIPTION OF THE PREFERRED EMBODIMENT

Figure 1:
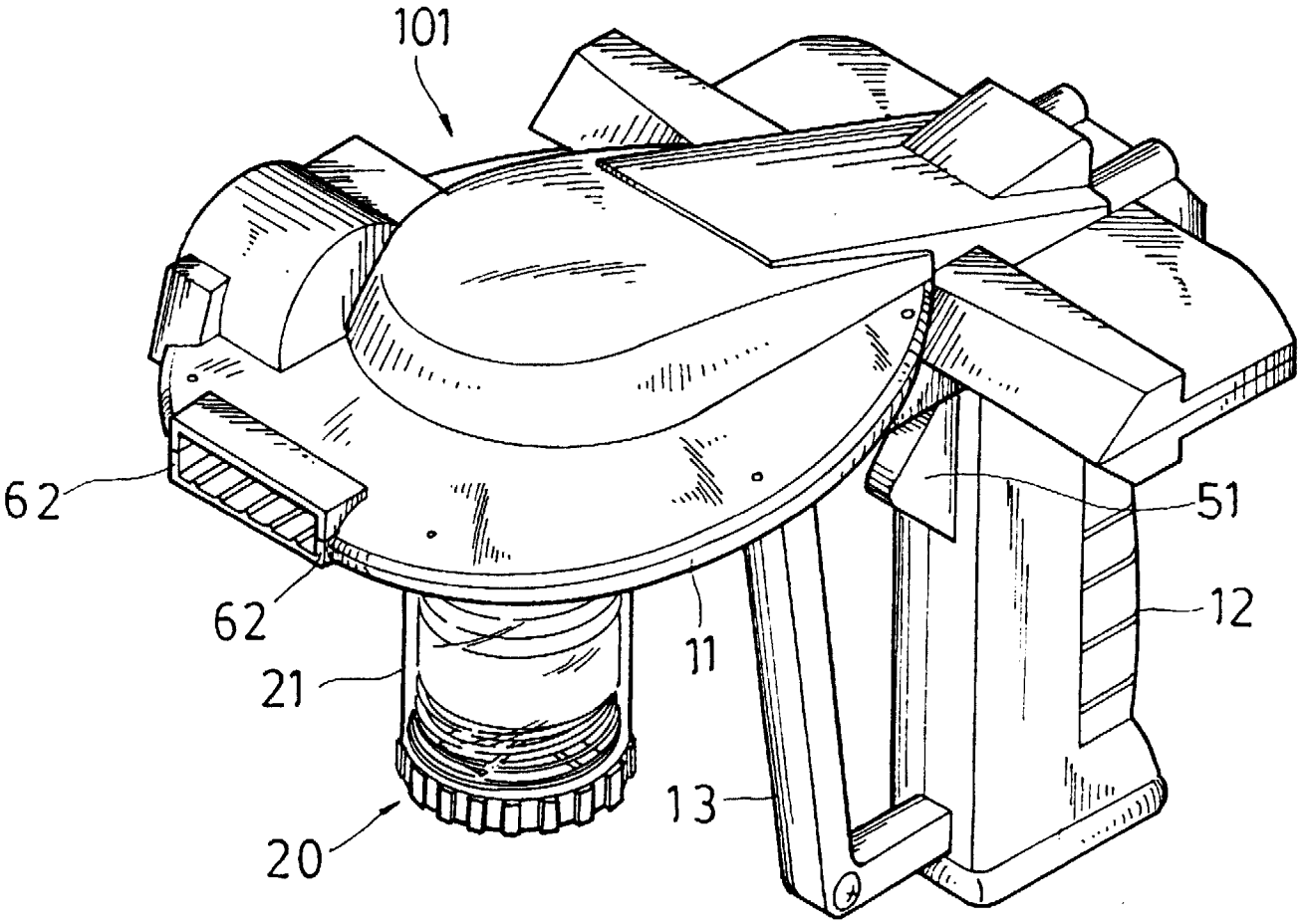
FIG. 1 is an elevational view of a toy flying disk and disk launcher system according to the present invention.
Figure 2:
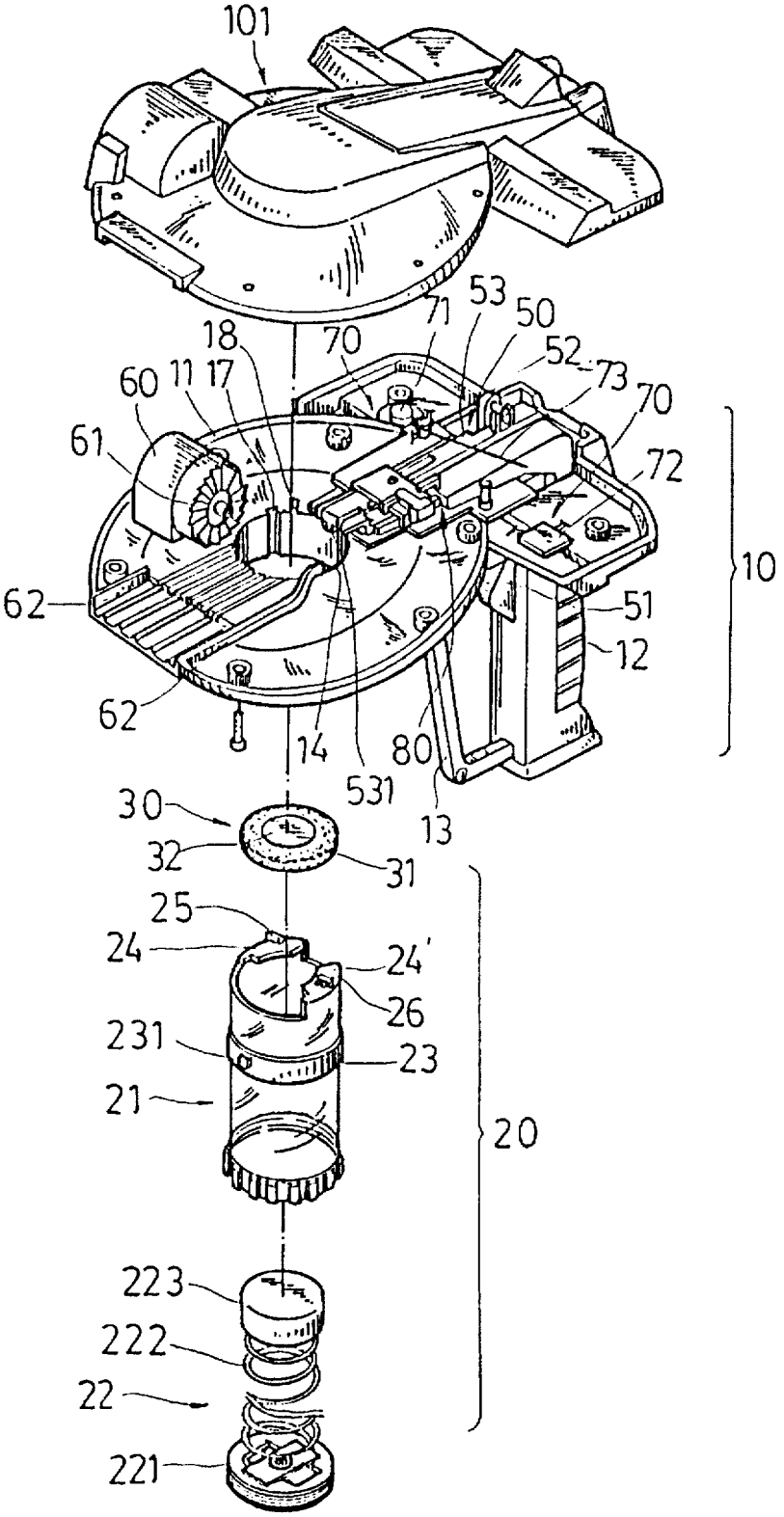
FIG. 2 is an exploded view of the toy flying disk and disk launcher system shown in FIG. 1.
Figure 3:
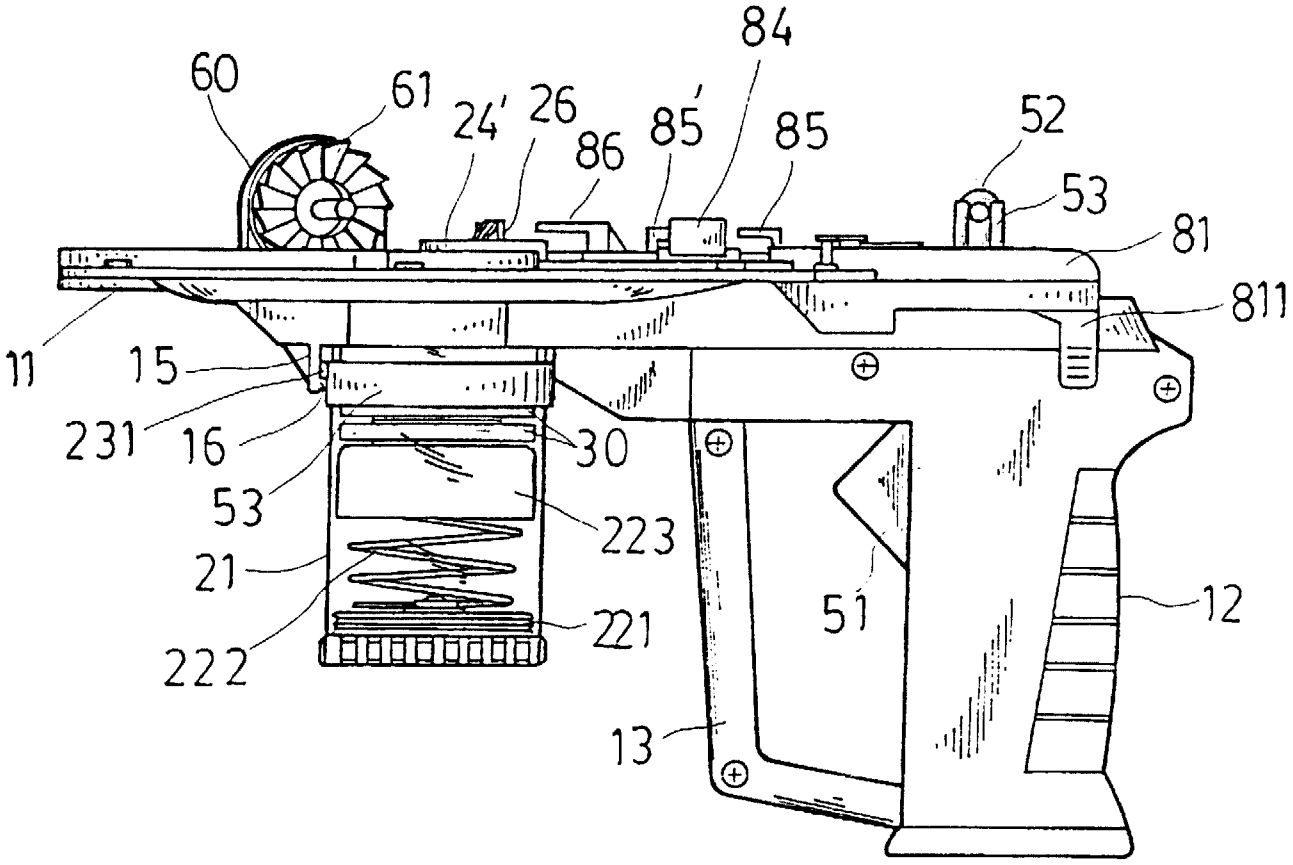
FIG. 3 is a side view of the toy flying disk and disk launcher system shown in FIG. 1.
Figure 6:
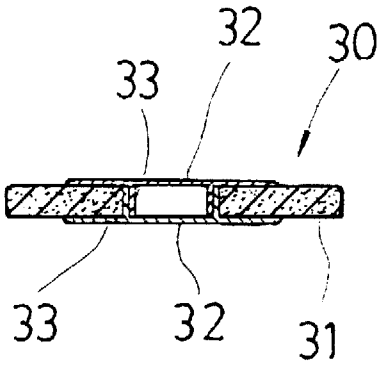
FIG. 6 is a side view in section of the toy flying disk shown in FIG. 4.
Figure 5:
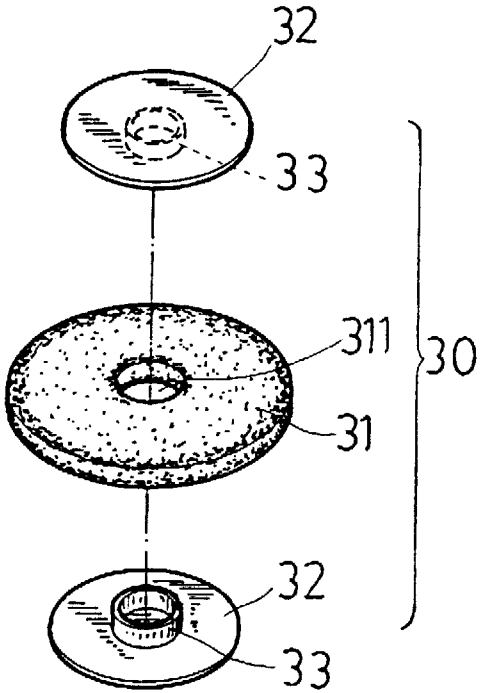
FIG. 5 is an exploded view of the toy flying disk shown in FIG. 4.
Figure 4:
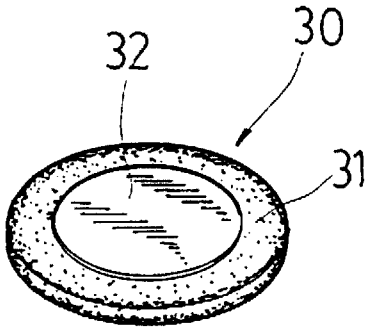
FIG. 4 is an elevational view of a toy flying disk according to the present invention.

Referring to FIGS. from 1 to 3, a toy flying disk and disk launcher system in accordance with the present invention is generally comprised of a launcher base 10, a disk feeder 20, flying disks 30, a disk launching control mechanism 50, a motor 60, a sound and light control unit 70, and a safety control device 80.

The launcher base 10 comprises a launching pad 11, a shield 101 covered over the launching pad 11, a handle 12 connected to one end of the launching pad 11, a brace 13 connected between the bottom side of the launching pad 11 and a lower part of the handle 12, a vertical disk feed hole 14 at the launching pad 11, a downwardly extended annular coupling flange 15 raised from the bottom side of the launching pad 11 around the vertical disk feed hole 14, locating means 16 disposed at the annular coupling flange 15, at least one sliding groove for example one sliding groove 17 axially disposed at the border of the vertical disk feed hole 14, and a stop block 18 raised from the top side of the launching pad 11 adjacent the sliding groove 17. The locating means 16 can be an inwardly extended hooked portion integral with the bottom edge of the annular coupling flange 15.

The disk feeder 20 is mounted in the vertical disk feed hole 14 at the bottom, comprised of a barrel 21 and a disk pusher 22. The disk pusher 22 comprises a circular bottom block 221 fixedly fastened to the bottom open end of the barrel 21, a circular push block 223 axially moved in the barrel 21, and a spring 222 connected between the circular bottom block 221 and the circular push block 223 and imparting an upward pressure to the circular push block 223. The barrel 21 comprises a collar 23 raised around the periphery adjacent its top open end, a projecting block 231 raised from the collar 23, a first stop block 24 and a second stop block 24' bilaterally and axially raised from its top open end at two opposite sides and adapted to stop the push block 223 of the disk pusher 22 from escaping out of the top open end of the barrel 21, a substantially L-shaped locating rod 25 raised from the first stop block 24, and a bevel block 26 raised from the second stop block 24'. When the L-shaped locating rod 25 is aimed at the vertical sliding groove 17, the barrel 21 is inserted through the vertical disk feed hole 14 of the launching pad 11 from the bottom side. After the L-shaped locating rod 25 passes over the top side of the launching pad 11, the barrel 21 is turned clockwise through a certain angle, permitting the L-shaped locating rod 25 to be abutted against the stop block 18 of the launcher base 10 and engaged with the top edge of the vertical disk feed hole 14. When the L-shaped locating rod 25 is abutted against the stop block 18 of the launcher base 10 and engaged with the top edge of the vertical disk feed hole 14, the projecting block 231 of the barrel 21 is forced into engagement with the locating means 16 of the launcher base 10, and therefore the disk feeder 20 is installed in the vertical disk feed hole 14. When the disk feeder 20 is installed, the opening defined between the top blocks 24;24' of the barrel 21 is maintained in line with the handle 12.

Referring to FIGS. from 4 to 6 and FIGS. from 1 to 3 again, a set of flying disks 30 are loaded in the barrel 21 of the disk feeder 20. Each flying disk 30 comprises a flat disk body 31 made from flexible material and having a center hole 311, and two end caps 32 fastened to the center hole 311 of the flat disk body 31 at two opposite sides. The end caps 32 have a respective coupling portion 33 coupled to each other. The end caps 32 can be made in the form of a snap comprised of a ball side with a ball and a socket side with a socket. When a set of flying disks 30 are loaded in the barrel 21 of the disk feeder 20, they are arranged in a stack and retained between the push block 223 of the disk pusher 22 and the stop blocks 24;24' of the barrel 21, and the top one of the loaded flying disks 30 is suspended above the vertical disk feed hole 14 for launching.

The aforesaid flat disk body 31 is preferably molded from rubber, polyethylene, vinyl chloride, etc., that does not cause an injury when it hits a person. The end caps 32 of each flying disk 30 are preferably molded from rigid plastic. Each end cap 32 has a smoothly curved outside wall. Because the smoothly curved outside walls of the end caps 32 of the flying disks 30 are disposed in contact with one another when the flying disks 30 are loaded in the barrel 21 of the disk feeder 20, less friction force is produced between each two adjacent flying disks 30, and therefore the flying disks 30 can be smoothly pushed out of the barrel 21 of the disk feeder 20 into the launching position one after another, and then sent into the air in proper order.

Referring to FIGS. 9A, 9B, 10A and 10B, and FIG. 2 again, the disk launching control mechanism 50 comprises a trigger 51 mounted on the handle 12 at an inner side, a push rod 53, a link 52 coupled between the trigger 51 and the push rod 53, a return spring 521 connected between the link 52 and the launching pad 11. When the trigger 51 is triggered, the link 52 is turned to push the push rod 53 forwards along a linear track 54 on the launching pad 11, causing the push rod 53 to push one flying disk 30 out of the vertical disk feed hole 14 into the launching position. On the contrary, when the trigger 51 is released, the return spring 521 immediately pulls back the link 52, and therefore the push rod 53 is returned to its former position. The push rod 53 has a bevel bottom flange 531 at its front side. When the push rod 53 is moved forwards to push a first flying disk 30 out of the barrel 21 of the disk feeder 20 into the launching position, the bevel bottom flange 531 of the push rod 53 is stopped above a second flying disk 30 in the barrel 21 of the disk feeder 20 to prevent direct contact between the first flying disk and the second flying disk, so that the first flying disk can be launched smoothly at a high speed.

The motor 60 is mounted on the launching pad 11 adjacent the launching position, having a ratchet wheel 61 fixedly mounted on its output shaft. When one flying disk 30 is pushed into the launching position, it is retained in contact with the periphery of the ratchet wheel 61. Therefore, the flying disk 30 is sent into the air by the ratchet wheel 61 when the motor 60 is started. Further, two upright guide walls 62 are made on the launching pad 11 at two opposite sides of the launching path for guiding the launching of the flying disk 30.

The sound and light control unit 70 comprises a buzzer 71, an electronic sound and light control circuit 72, and a control switch 73. The control switch 73 is mounted in the path of the push rod 53. When the trigger 51 is triggered, a first flying disk 30 is pushed out of the disk feeder 20 into the launching position, and at the same time the control switch 73 is switched on by the push rod 53, causing the electronic sound and light control circuit 72 to produce a lighting effect and to make a sound through the buzzer 71. The electronic sound and light control circuit 72 can easily be achieved by conventional techniques, therefore it is not described herein in detail.

Figure 7:
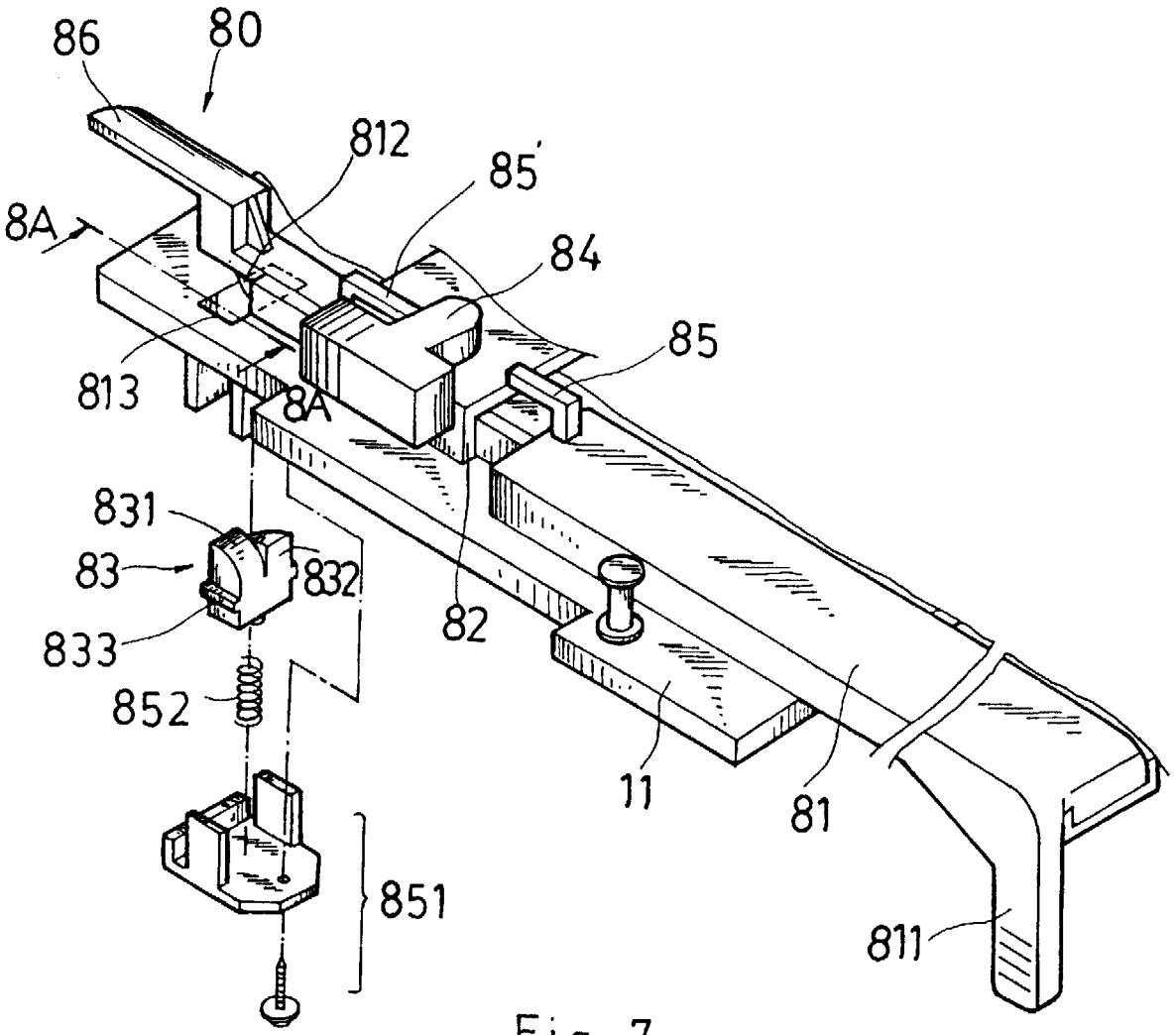
FIG. 7 is an exploded view of the safety control device according to the present invention.
Figure 8A:
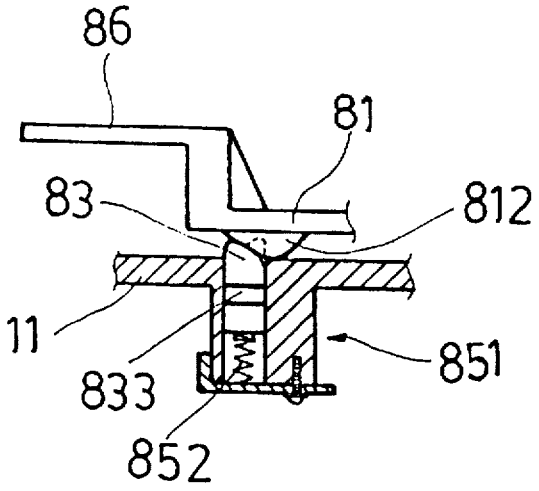
FIG. 8A is a sectional view taken along line 8A—8A of FIG. 7.
Figure 8B:
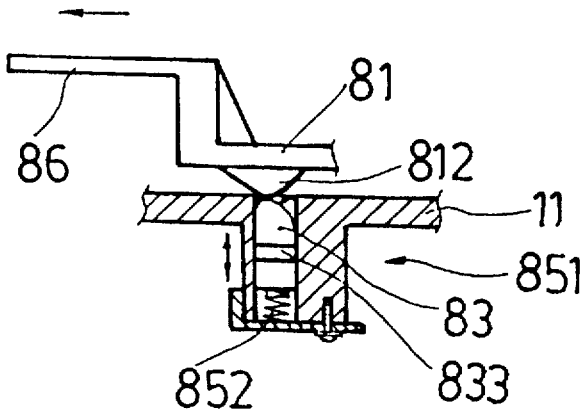
FIG. 8B is similar to FIG. 8A but showing the safety bar pushed forwards, the retainer block forced downwards.
Figure 9A:
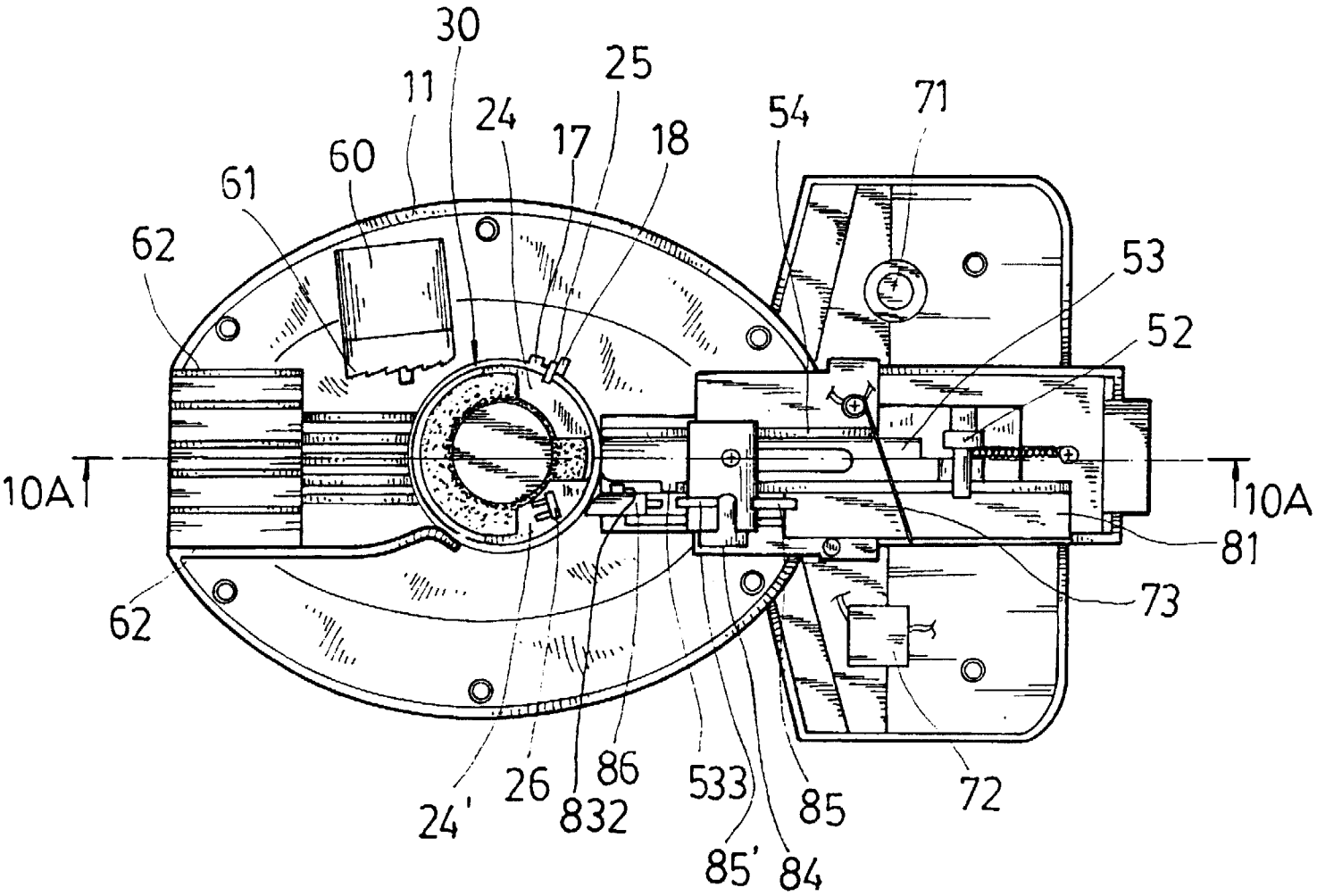
FIG. 9A is a top plan view of the present invention, showing the disk launching control mechanism locked, the power switch switched off.
Figure 9B:
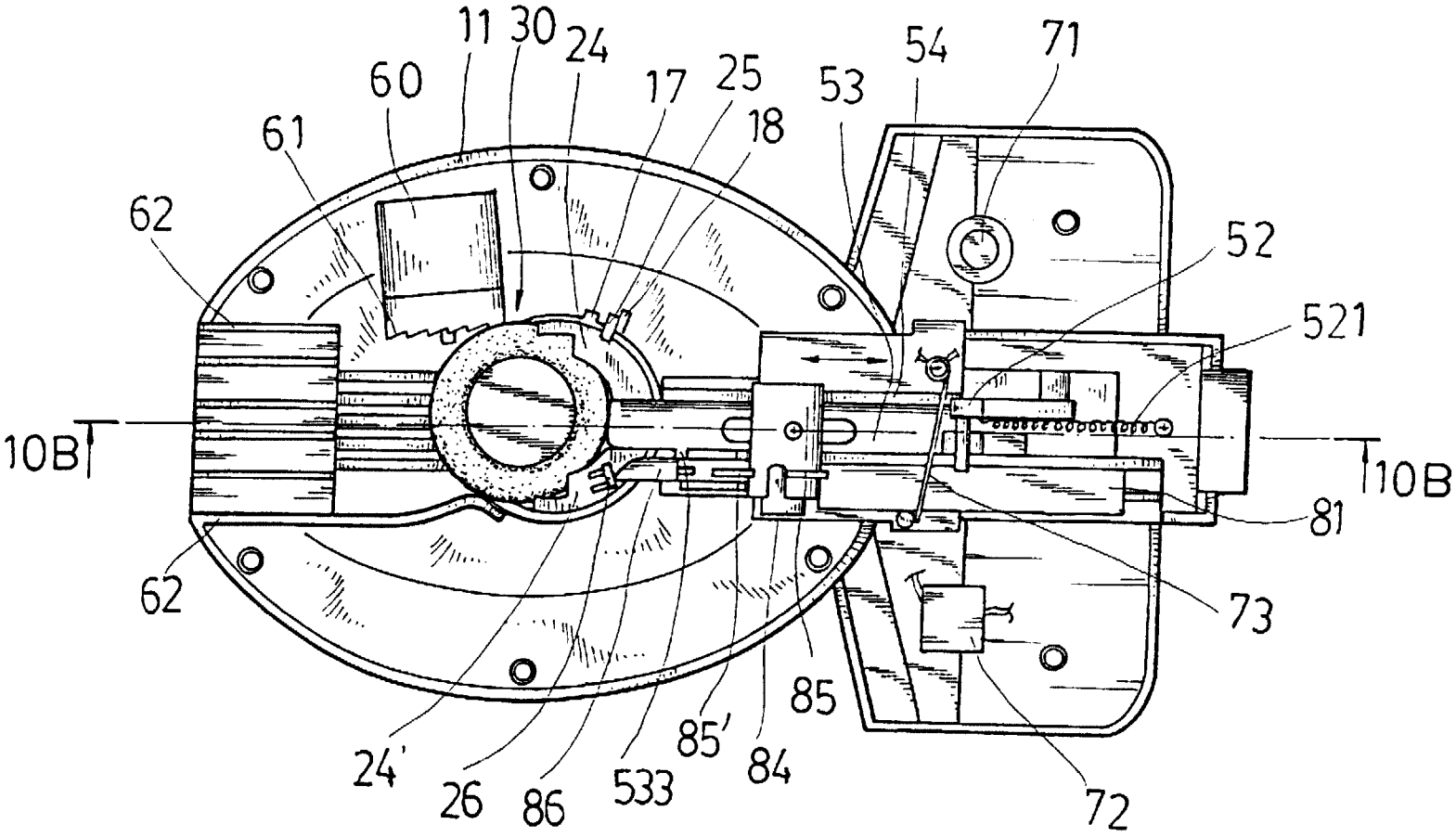
FIG. 9B is another top plan view of the present invention, showing the disk launching control mechanism unlocked, the push rod pushed forwards, the power switch switched on, one toy flying disk moved into engagement with the ratchet wheel.
Figure 10A:
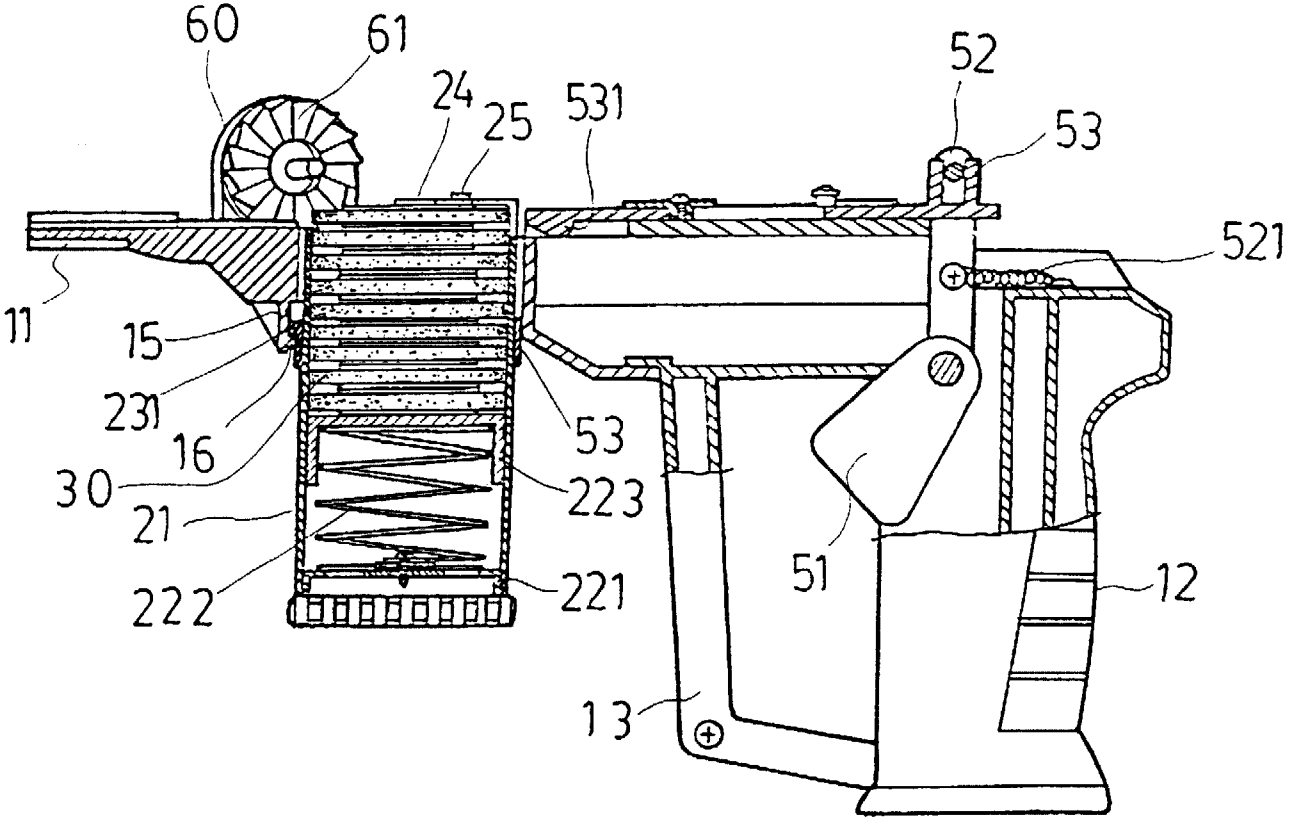
FIG. 10A is a sectional view taken along line 10A—10A of FIG. 9A.
Figure 10B:
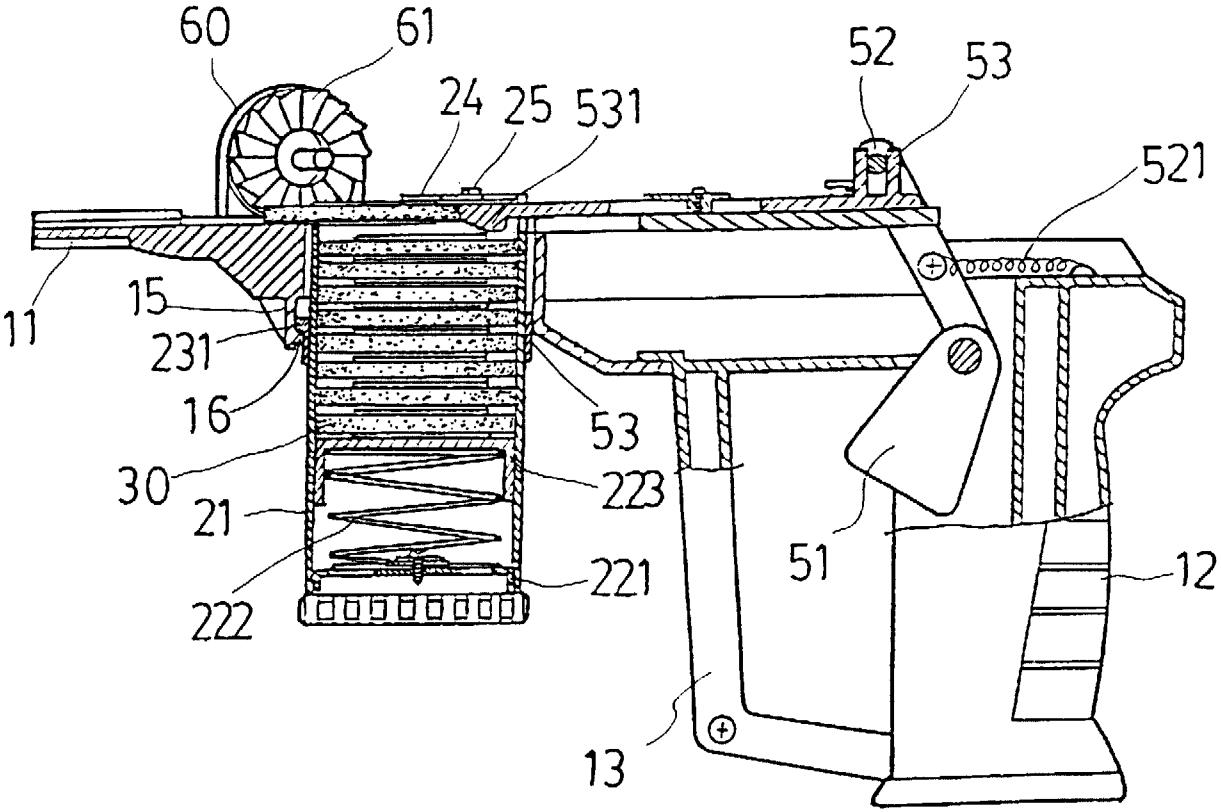
FIG. 10B is a sectional view taken along line 10B—10B of FIG. 9B.

Referring to FIGS. 7, 8A and 8B, the safety control device 80 is mounted on the launching pad 11 at one side of the push rod 53. The safety control device 80 comprises a sliding track 82 fixedly mounted on the launching pad 11, a safety bar 81 moved in the sliding track 82 and having a length approximately equal to the push rod 53, a slot 813 at the launching pad 11 below the push rod 53, and a retainer block 83 moved up and down in the slot 813. The safety bar 81 comprises a downward finger rod 811 downwardly extended from its rear end and suspended below the launching pad 11, and a conical projection 812 raised from its front end of the safety bar 81 at the bottom. The retainer block 83 comprises an arched face 831 at its top side adapted to act against the conical projection 812, and a stop face 832 at its back side adapted to engage the push rod 53. The push rod 53 has a side projection 533 raised from its one side (see also FIG. 9A). When the retainer block 83 is moved upwards, the stop face 832 of the retainer block 83 is forced into engagement with the side projection 533 of the push rod 53 to stop the push rod 53 from forward movement. A holder frame 851 is fastened to the launching pad 11 and suspended below the slot 813. A spring 852 is mounted on the holder frame 851 to support the retainer block 83 and to push it upwards. The retainer block 83 further comprises two side rails 833 raised from its two opposite sides and stopped below the launching pad 11 to limit the elevation of the up stroke of the retainer block 83. Further, a power switch 84 is suspended above the sliding track 82, and connected to the motor 60 and the sound and light control unit 70 by a power circuit. Two actuating rods, namely, the first actuating rod 85 and the second actuating rod 85' are raised from the top side of the safety bar 81 and disposed at two opposite sides relative to the power switch 84. When the safety bar 81 is pushed forwards, the first actuating rod 85 is forced to switch on the power switch 84, causing the motor 60 and the sound and light control unit 70 to be started. On the contrary, when the safety bar 81 is pulled back, the second actuating rod 85' is forced to switch off the power switch 84, thereby causing the motor 60 and the sound and light control unit 70 to be turned off. When the user pulls the downward finger rod 811 of the safety bar 81 backwards, the power switch 84 is switched off, the conical projection 812 is released from the arched face 831 of the retainer block 83, and the retainer block 83 is forced out of the slot 813, thereby causing the stop face 832 of the retainer block 83 to be forced into engagement with the side projection 533 of the push rod 53, and therefore the push rod 53 is prohibited from forward movement. On the contrary, when the user pushes the finger rod 811 to move the safety bar 81 forwards, the power switch 84 is switched on to turn on the motor 60 and the sound and light control unit 70, and the conical projection 812 is moved forwards against the arched face 831 of the retainer block 83, thereby causing the retainer block 83 to be forced downwards and received inside the slot 813, and therefore the stop face 832 of the retainer block 83 is released from the side projection 812. When the trigger 51 is depressed after the stop face 832 of the retainer block 83 has been released from the side projection 812, the push rod 53 is pushed forwards to move one flying disk 30 out of the disk feeder 20 into the launching position. When one flying disk 30 is moved into the launching position, it is immediately sent into the air by the ratchet wheel 61. Furthermore, there is provided a guide rod 86 extended from the front end of the safety bar 81. When the safety bar 81 is pushed forwards, the guide rod 86 is moved to the top of the second stop block 24' of the barrel 21 of the disk feeder 20 and forced into engagement with the bevel block 26. When the barrel 21 is turned counter-clockwise, the guide rod 86 will be forced by the bevel block 26 to push the safety bar 81 backwards, causing the second actuating rod 85' to switch off the power switch 84, and at the same time the retainer block 83 is released from the safety bar 81 and forced upwards by the spring 852 into engagement with the push rod 53.

Because of the arrangement of the safety control device 80, the trigger 51 is not operative when electric power supply is not connected or there is no flying disk loaded in the disk feeder 20.

While only one embodiment of the present invention has been shown and described, it will be understood that various modifications and changes could be made thereunto without departing from the spirit and scope of the invention disclosed.

What I claim is:

1. A toy flying disk and disk launcher system comprising:

a launcher base, said launcher base comprising a launching pad, a slot at said launching pad, a shield covered over said launching pad, a handle connected to one end of said launching pad, and a vertical disk feed hole at said launching pad in front of said slot;

a disk feeder mounted in said vertical disk feed hole at a bottom side and adapted to feed flying disks one after another into position for launching, said disk feeder comprised of a barrel adapted to hold flying disks and a disk pusher adapted to push loaded flying disks out of said barrel, said barrel comprising at least one stop block raised from a top side thereof and adapted to hold loaded flying disks in place;

a plurality of flying disks loaded in said barrel of said disk feeder and arranged in a stack stopped below the at least one stop block of said barrel and pushed into a launching position one after another by a disk launching control mechanism;

a motor mounted on said launching pad, said motor having a motor shaft fixedly mounted with a ratchet wheel, said ratchet wheel being turned to send said flying disks one after another from said launching position into the air by means of the control of a disk launching control mechanism;

a disk launching control mechanism controlled to push said flying disks out of said disk feeder into said launching position one after another for launching, and simultaneously to drive said motor and said ratchet wheel in sending said flying disks from said launching position into the air one after another, said disk launching control mechanism comprising a trigger mounted on said handle at an inner side, a push rod driven by said trigger to push said flying disks out of said disk feeder into said launching position, a link coupled between said trigger and said push rod, a return spring connected between said link and said launching pad, said push rod having a bevel bottom flange at a front side, said bevel bottom flange of said push rod being stopped above a second flying disk in said barrel of said disk feeder when a first flying disk is pushed out of said barrel into said launching position, permitting the first flying disk to be sent into the air by said ratchet wheel;

a power switch adapted to control electric power supply to said motor; and a safety control device mounted on said launching pad and adapted to switch on/off said power switch and to lock/unlock said disk launching control mechanism, said safety control device comprising a sliding track fixedly mounted on said launching pad, a safety bar moved in said sliding track between a first position in which said power switch is switched on and said disk launching control mechanism is unlocked, and a second position in which said power switch is switched off and said disk launching control mechanism is locked, a retainer block moved up and down in said slot of said launching pad, said retainer block comprising an arched face, and a stop face which is forced into engagement with said push rod to stop it from forward movement when said bumper is pulled from said first position to said second position, a downward finger rod at a rear end of said safety bar through which said safety bar is moved between said first position and said second position by hand, a conical projection raised from a front end of said safety bar and adapted to act against the arched face of said retainer block, a holder frame fastened to said launching pad and suspended below said slot, and spring means mounted on said holder frame to impart an upward pressure to said retainer block, a first actuating rod and a second actuating rod respectively raised from a top side of said safety bar, said first actuating rod being moved with said safety bar to switch on said power switch when said safety bar is moved from said second position to said first position, said second actuating rod being moved with said safety bar to switch off said power switch when said safety bar is moved from said first position to said second position.

2. The toy flying disk and disk launcher system of claim 1, wherein said launching pad comprises a downwardly extended annular coupling flange raised from a bottom side thereof around said vertical disk feed hole, at least one sliding groove axially disposed inside said vertical disk feed hole, and a stop block raised from a top side thereof adjacent said sliding groove; said barrel of said disk feeder comprises at least one substantially L-shaped locating rod respectively raised from its at least one stop block, said at least one L-shaped locating rod being respectively inserted through the at least one sliding groove of said launching pad and then forced into engagement with a top edge of said vertical disk feed hole upon a rotary motion of said barrel in said vertical disk feed hole.

3. The toy flying disk and disk launcher system of claim 1, wherein said disk pusher comprises a circular bottom block fixedly fastened to a bottom open end of said barrel, a circular push block axially moved in said barrel, and spring means connected between said circular bottom block and said circular push block and imparting an upward pressure to said circular push block.

4. The toy flying disk and disk launcher system of claim 1, wherein each of said flying disks comprises a flat disk body made from flexible material and having a center hole, and two end caps fastened to the center hole of said flat disk body at two opposite sides, said end caps having a respective smoothly curved outside wall.

5. The toy flying disk and disk launcher system of claim 1, further comprising a sound and light control unit mounted on said launching pad and controlled by the trigger of said disk launching control mechanism to produce sound and light effects.

6. The toy flying disk and disk launcher system of claim 1, wherein said safety control device further comprises a guide rod extended from a front end of said safety bar, said guide rod being forced by a bevel block at one of the at least one stop block of said barrel to push said push said safety bar backwards when said barrel is turned counter-clockwise and disengaged from said vertical disk feed hole, causing said power switch to be switched off and said retainer block to be released from said safety bar and forced into engagement with said push rod.

* * * * *